US006971127B2

(12) United States Patent
Richards

(10) Patent No.: US 6,971,127 B2
(45) Date of Patent: Dec. 6, 2005

(54) INFANT ROCKING APPARATUS

(75) Inventor: John H. Richards, Warrington, PA (US)

(73) Assignee: Hill-Rom Services, Inc., Batesville, IN (US)

( * ) Notice: Subject to any disclaimer, the term of this patent is extended or adjusted under 35 U.S.C. 154(b) by 441 days.

(21) Appl. No.: 10/028,620

(22) Filed: Dec. 20, 2001

(65) Prior Publication Data

US 2002/0100116 A1 Aug. 1, 2002

Related U.S. Application Data

(60) Provisional application No. 60/258,012, filed on Dec. 22, 2000.

(51) Int. Cl.[7] ..... A47D 9/02

(52) U.S. Cl. ..... 5/108; 5/109

(58) Field of Search ..... 5/109, 108, 107, 5/105, 609, 615, 715; 600/22

(56) References Cited

U.S. PATENT DOCUMENTS

| | | | | | |
|---|---|---|---|---|---|
| 720,410 | A | | 2/1903 | Drubech | 5/103 |
| 1,354,907 | A | | 10/1920 | Hopaidaszka | 5/109 |
| 1,727,635 | A | | 9/1929 | Crane | 5/109 |
| 1,772,310 | A | | 8/1930 | Hart | 5/713 |
| 2,520,563 | A | | 8/1950 | Preston | 5/109 |
| 2,841,802 | A | | 7/1958 | Leverett | 5/109 |
| 2,855,921 | A | | 10/1958 | Grosholz | 601/42 |
| 2,979,735 | A | | 4/1961 | Helmer | 5/109 |
| 3,031,687 | A | | 5/1962 | Stevens et al. | 5/109 |
| 3,225,365 | A | * | 12/1965 | Miller et al. | 5/109 |
| 3,261,032 | A | | 7/1966 | Reardon | 5/108 |
| 3,378,859 | A | | 4/1968 | Parker | 5/109 |
| 3,935,604 | A | | 2/1976 | Collins | 5/630 |
| 4,014,344 | A | * | 3/1977 | Gutierrez | 5/609 X |
| 4,080,673 | A | * | 3/1978 | Weisler | 5/108 X |
| 4,188,677 | A | * | 2/1980 | Zur | 5/615 |
| 4,452,572 | A | | 6/1984 | Evrard | 417/395 |
| 4,590,631 | A | | 5/1986 | Varney | 5/101 |
| 4,881,285 | A | * | 11/1989 | Zeeb | 5/109 X |
| 4,885,918 | A | * | 12/1989 | Vaccaro | 600/22 |
| 4,934,002 | A | | 6/1990 | Watanabe | 5/607 |
| 4,935,968 | A | * | 6/1990 | Hunt et al. | 5/713 |
| 5,062,167 | A | | 11/1991 | Thomas et al. | 5/614 |
| 5,073,999 | A | | 12/1991 | Thomas et al. | 5/615 |
| 5,103,511 | A | | 4/1992 | Sequin | 5/607 |
| 5,170,522 | A | * | 12/1992 | Walker | 5/615 |
| 5,181,288 | A | | 1/1993 | Heaton et al. | 5/607 |
| 5,183,457 | A | | 2/1993 | Gatts et al. | 600/21 |
| 5,244,452 | A | | 9/1993 | Vaccaro et al. | 600/22 |
| 5,375,273 | A | | 12/1994 | Bodine, Jr. et al. | 5/710 |
| 5,410,768 | A | * | 5/1995 | Manson et al. | 5/609 |
| 5,586,346 | A | | 12/1996 | Stacy et al. | 5/710 |
| 5,624,375 | A | * | 4/1997 | Dykes et al. | 600/22 |
| 5,742,960 | A | | 4/1998 | Shamir | 5/107 |
| 5,781,949 | A | | 7/1998 | Weismiller et al. | 5/715 |
| 5,860,899 | A | * | 1/1999 | Rassman | 5/609 X |
| 5,983,429 | A | | 11/1999 | Stacy et al. | 5/713 |
| 6,013,022 | A | * | 1/2000 | Jones et al. | 600/22 |
| 6,263,526 | B1 | | 7/2001 | Tu | 5/109 |
| 6,671,900 | B2 | * | 1/2004 | Davis | 5/118 |
| 2002/0100116 | A1 | * | 8/2002 | Richards | 5/108 |

FOREIGN PATENT DOCUMENTS

| | | |
|---|---|---|
| JP | S58-89028 | 6/1983 |
| JP | H4-15467 | 2/1992 |
| WO | WO 98/17150 | 4/1998 |
| WO | PCT/US01/49754 | 12/2001 |

* cited by examiner

*Primary Examiner*—Robert G. Santos
(74) *Attorney, Agent, or Firm*—Barnes & Thornburg

(57) ABSTRACT

An infant rocking apparatus comprises an infant support and lifters that rock the infant support from side to side. In illustrative embodiments, the infant support has a trough in which an infant is received. A number of different types of lifters and orientations of the lifters are disclosed.

60 Claims, 8 Drawing Sheets

INFANT ROCKING APPARATUS

This application claims priority under 35 U.S.C. 119(e) to U.S. Provisional application Ser. No. 60/258,012, filed Dec. 22, 2000, which is expressly incorporated by reference herein.

BACKGROUND AND SUMMARY

The present disclosure relates to apparatus that rock infants, and particularly to apparatus that rock infants from side-to-side.

It is well known that a parent cradling an infant in her/his arms and making a rocking motion can provide a sense of calm, comfort, and security to the infant. Some infant support devices, such as cribs and child swings, include mechanisms that rock the infant from side-to-side or swing the infant back-and-forth. Rocking mechanisms associated with cribs usually rock a mattress of the crib along with the structure underlying the mattress and the crib rails that surround the mattress. Child swings typically have a child seat, hanger arms extending upwardly from the seat, and a motor or other mechanism that is supported by a stand above the seat and that oscillates the hanger arms to produce a back-and-forth swinging motion of the seat.

Infant incubators, infant warmers, bassinets and other such infant support devices that have either a partially enclosed or fully enclosed space for receiving and restricting the movement of an infant are known. These infant support devices are typically found in hospitals and include a mattress for supporting the infant in the enclosed space and a deck supporting the mattress. Many infant support devices include mechanisms for tilting the deck and the mattress between Trendelenburg and reverse Trendelenburg positions. However, most infant support devices in hospitals do not have mechanisms for rocking the infants supported by the devices. Some known infant support devices have an overhead structure, such as a canopy, a heater, or both, situated above the mattress. Therefore, it is impractical to have mechanisms for rocking the deck and mattress located above the mattress of an infant incubator or infant warmer because such mechanisms may interfere with the proper operation of the canopy or the heater.

Most conventional infant support devices have a set of panels or walls that extend upwardly from a platform of the infant support device and that are arranged around the mattress. If a canopy is included in the infant support device, it usually is supported by an arm that extends upwardly from the platform. Canopies typically cooperate with the panels or walls to form an isolation chamber for the infant. The platform of infant incubators and infant warmers usually houses heating equipment, humidification equipment, air circulation equipment, and an electrical control system for controlling the equipment. Thus, the platform of most infant incubators and infant warmers is a relatively heavy structure. As a result, rocking an infant by rocking the entire platform and the various structures carried by the platform of an infant incubator or an infant warmer is impractical.

According to the present disclosure, an infant rocking apparatus comprises an infant support having opposite ends and longitudinally-extending side portions. The infant support also has a longitudinally-extending central portion that is situated between the side portions and that is recessed downwardly from the side portions to define a trough which receives an infant. The rocking apparatus further comprises a pair of lifters. Each lifter is coupled to a respective side portion and operates to raise and lower the side portions to tilt the infant support from side to side to simulate a rocking motion.

In illustrative embodiments, the side portions extend laterally outwardly from the upper edges of the trough. The trough cradles the infant received therein and inhibits the infant from moving laterally toward the sides of the infant support when the infant support is tilted. The lifters are positioned beneath the respective side portions of the infant support and the trough is positioned in a space defined between the lifters. In some illustrative embodiments, the lifters comprise pneumatic bellows. In other illustrative embodiments, the lifters comprise pneumatic cylinders. In further illustrative embodiments, the lifters comprise linkages that are pivoted by one or more actuators.

A control system that controls movement of the lifters is also disclosed. The control system operates the lifters to rock the infant support from side to side. In some illustrative embodiments, the rocking apparatus has a base that is positioned beneath the infant support. Each of the lifters extends between a respective side portion and the base. The rocking apparatus disclosed herein is usable by itself or may be placed in, for example, a crib, an infant incubator, an infant warmer, or a bassinet. In some embodiments, the rocking apparatus disclosed herein is integrated into, for example, a crib, an infant incubator, an infant warmer, or a bassinet.

Additional features and advantages of the infant rocking apparatus will become apparent to those skilled in the art upon consideration of the following detailed description of illustrative embodiments which exemplify the best mode of making and using the infant rocking apparatus as presently perceived.

BRIEF DESCRIPTION OF THE DRAWINGS

The detailed description particularly refers to the accompanying figures in which.

Corresponding reference characters indicate corresponding parts throughout the several views. The exemplification set out herein illustrates several embodiments of an infant rocking apparatus, and such exemplification is not to be construed as limiting the scope of the invention in any manner.

DETAILED DESCRIPTION OF THE DRAWINGS

Figure 1:
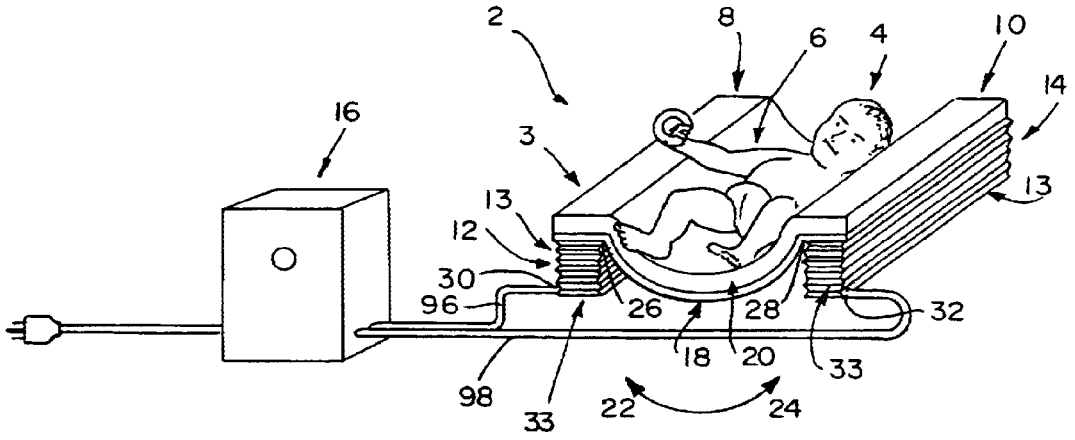
FIG. 1 is a perspective view of an infant rocking apparatus according to this disclosure showing an infant lying on an infant support of the infant rocking apparatus, a pair of pneumatic bellows situated beneath side portions of the infant support, and a control system coupled to the pneumatic bellows by a pair of pneumatic lines.

A rocking apparatus 2 is configured to receive an infant 4, and comprises an infant support 3, a pair of lifters 13, and a control system 16 as shown in FIG. 1. Infant support 3 comprises a panel or platform portion 18 and a mattress 20 that rests on panel 18. Illustratively, panel 18 and mattress 20 are shaped to provide infant support 5 with a trough 6 and side portions 8, 10 that extend laterally outwardly from the uppermost side regions 26, 28 of trough 6, respectively. Trough 6 is recessed below side portions 8, 10 and cradles an infant placed in trough 6 as shown in FIG. 1. In the illustrated embodiment, side portions 8, 10 are integral with trough 6. In alternative embodiments, separate, longitudinally-extending panels or blocks are attached to the uppermost side regions 26, 28 of trough 6, or anywhere on trough 6.

Lifters 13 of apparatus 2 comprise pneumatic bellows 12, 14. Bellows 12, 14 are positioned beneath side portions 8, 10, respectively, and are spaced apart to define a space that receives trough 6. Bellows 12, 14 are inflated and deflated by control system 16 to control the movement of infant support 3 as will be described in further detail below. In embodiments where apparatus 2 is integrated into an infant support device, such as a crib, an infant incubator, an infant warmer, or a bassinet, the bottoms of bellows 12, 14 are attached to underlying support structure of the infant support device. In embodiments where apparatus 2 is a free-standing unit, apparatus 2 comprises a base 50 to which the bottoms of bellows 12, 14 couple as shown in FIGS. 3*a* and 5*a*–5*c*. Connection ports 30, 32 are coupled to bellows 12, 14, respectively, and each connection port 30, 32 has a passage that communicates pneumatically with the interior region of the associated bellows 12, 14. A pair of pneumatic lines or hoses 96, 98 extend from control system 16 to the respective connection ports 30, 32 to pneumatically couple control system 16 to bellows 12, 14.

Figure 2A:
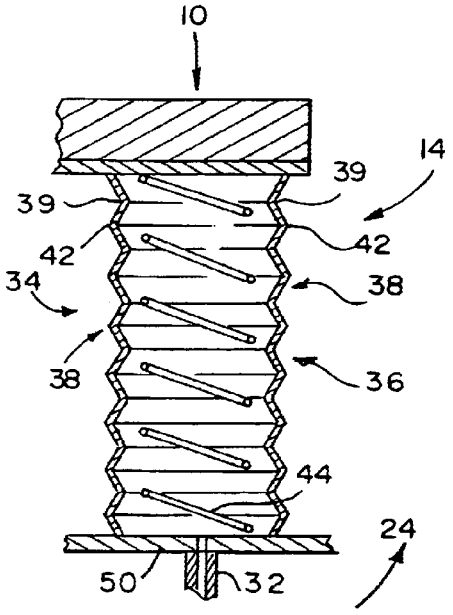
FIGS. 2*a* and 2*b* are cross-sectional views of one of the bellows of FIG. 1 showing the bellows in an expanded configuration and a contracted configuration, respectively.
Figure 2B:
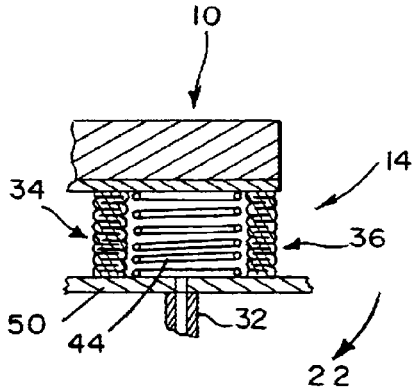

Bellows 12, 14 each comprise pleated side walls 34, 36 and pleated end walls 33 as shown in FIGS. 1, 2*a* and 2*b*. Each pleat 38 of side walls 34, 36 extends longitudinally the length of bellows 12, 14 and has inwardly-directed portions 39 and outwardly-extending portions 42. End walls 33 of bellows 12, 14 are similarly pleated except that the associated pleats extend transversely rather than longitudinally as shown in FIG. 1. The pleated configuration of side walls 34, 36 and end walls 33 allows bellows 12, 14 to expand upwardly or contract downwardly as shown in FIGS. 2*a* and 2*b* with regard to bellows 14. One or more springs 44 are situated within each of bellows 12, 14, as also shown in FIGS. 2*a* and 2*b*. Springs 44 are maintained in a state of compression between an underside of the associated side portion 8, 10 and any underlying support structure, such as base 50, to provide added support to infant support 3. Thus, springs 44 are biased to resist the contraction of bellows 12, 14.

Each of bellows 12, 14 is inflatable to an expanded configuration shown, for example, in FIG. 2*a* with regard to bellows 14, and is deflatable to a contracted configuration shown, for example, in FIG. 2*b* with regard to bellows 14. If bellows 12, 14 are inflated at the same time and at the same rate, infant support 3 moves upwardly without tilting as suggested by the horizontal orientation of side portion 10 shown in FIG. 2*a*. If bellows 12, 14 are deflated at the same time and at the same rate, infant support 3 moves downwardly without tilting as suggested by the horizontal orientation of side portion 10 shown in FIG. 2*b*.

If one of bellows 12, 14 is inflated while the other of bellows 12, 14 is deflated or remains static, then infant support 3 tilts. Similarly, if one of bellows 12, 14 is deflated while the other of bellows 12, 14 is inflated or remains static, then infant support 3 tilts. The phrase "remains static" in the preceding sentences means that air is neither introduced into nor evacuated out of the associated bellows 12, 14. It will be appreciated that the bellows 12, 14 defined as being static may, in fact, deform by a slight amount due to the physical forces imparted on the static bellows 12, 14 by infant support 3 as infant support 3 tilts. In addition, if more air is introduced into one of bellows 12, 14 than is introduced into the other of bellows 12, 14, then infant support 3 tilts. Similarly, if more air is removed from one of bellows 12, 14 than the other of bellows, infant support 3 tilts.

It will be appreciated that control system 16 is programmable and configurable to tilt infant support 3 in any of the following ways: (1) substantially equivalent amounts of air are simultaneously evacuated from one of bellows 12, 14 and introduced into the other of bellows 12, 14; (2) different amounts of air are evacuated from one of bellows 12, 14 and introduced into the other of bellows 12, 14; (3) more air is introduced into one of bellows 12, 14 than is introduced into the other of bellows 12, 14; and (4) more air is removed from one of bellows 12, 14 than the other of bellows 12, 14.

Infant support 3 is rocked side to side by alternately tilting infant support 3 in one direction so that portion 8 is lower in elevation than portion 10 and then tilting infant support 3 in an opposite direction so that portion 8 is higher in elevation than portion 10. For example, alternating inflation and deflation of bellows 12, 14 in a cyclic manner, such that as bellows 12 is inflated, bellows 14 is deflated 14, and such that as bellows 12 is deflated, bellows 14 is inflated, rocks infant support 3 from side to side. Because infant support 3 is tiltable in a variety of ways, as described above, a variety of types of rocking motions are achievable in apparatus 2 within the scope of this disclosure. In one example, control system 16 operates bellows 12, 14 so that infant support 3 moves between a level or home position, shown in FIGS. 3*a* and 5*a*, a first tilted position, shown in FIG. 5*b*, and a second tilted position, shown in FIG. 5*c*.

Figure 3A:
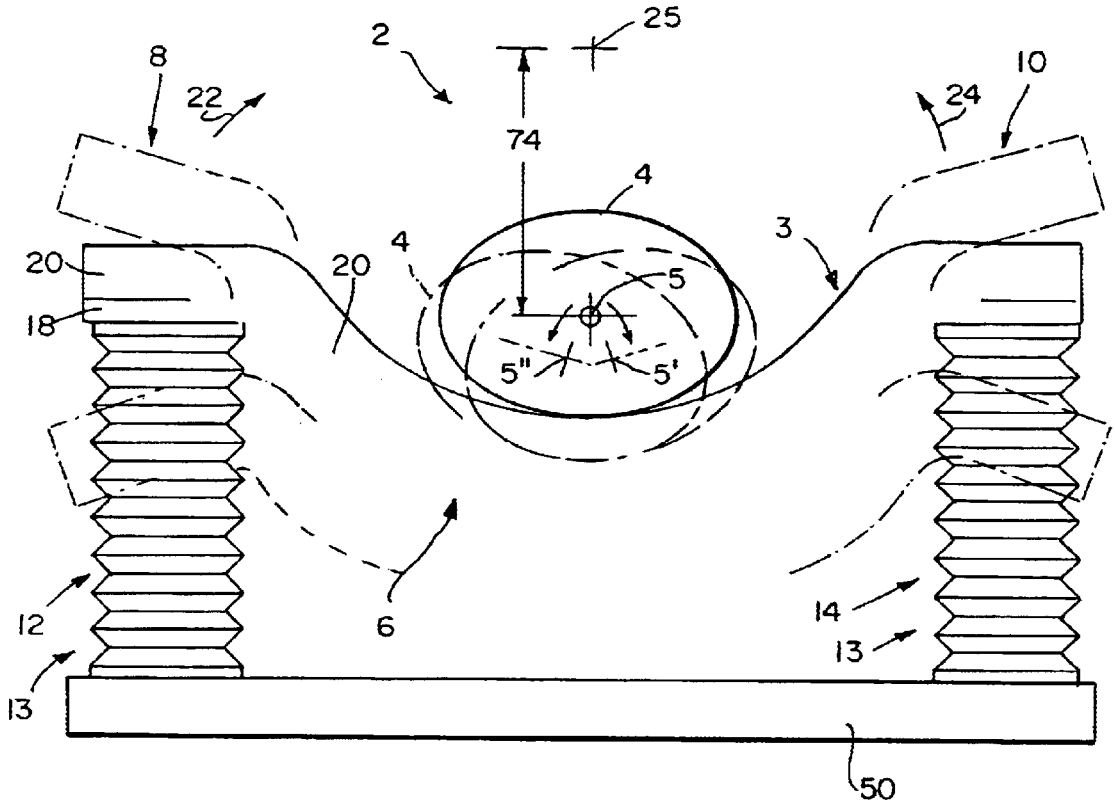
FIG. 3*a* is an end view of the apparatus of FIG. 1 showing the infant support in a level or home position (in solid lines) and being movable side-to-side to respective first and second tilted positions (in dotted lines)
Figure 3B:
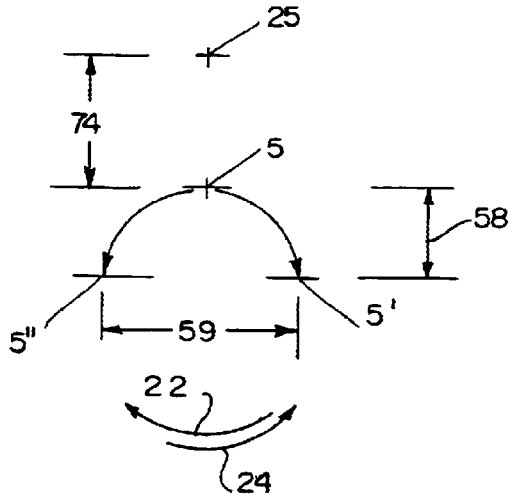
FIG. 3*b* is a diagrammatic view of the motion the infant travels when the infant support moves between the home position and the first and second tilted positions.

Infant support 3 pivots in a first direction indicated by arrow 22 in FIGS. 3*a* and 3*b* when moving toward the first tilted position and infant support 3 pivots in a second direction indicated by arrow 24 in FIGS. 3*a* and 3*b* when moving toward the second tilted position. Therefore, at any instance in time during tilting movement of infant support 3, there is an "effective" pivot axis about which infant support 3 is pivoting. This "effective" pivot axis is indicated diagrammatically in FIGS. 3*a* and 3*b* at reference numeral 25. It will be appreciated that FIGS. 3*a* and 3*b* are not necessarily to scale and that the actual location of the "effective" pivot axis of infant support 3 may be at a location other than the location at which axis 25 is shown in FIGS. 3*a* and 3*b*. In FIGS. 3*a* and 3*b*, a distance 74 separates axis 25 and the longitudinal centerline 5 of infant 4.

In the illustrative embodiments, lifters 13 are controlled by control system 16 so that the "effective" pivot axis is situated above the longitudinal centerline of infant 4. However, it is within the scope of this disclosure for lifters 13 to be operated such that the "effective" pivot axis coincides with the centerline of infant 4 or such that the "effective" pivot axis is below the longitudinal centerline of infant 4. In those embodiments where control system 16 operates so that the "effective" pivot axis is above the longitudinal centerline of infant 4, the resultant rocking motion of infant support 3 simulates the rocking motions of devices like swings having a person support that is suspended at the bottom of one or more hanger arms, chains, cables, links, or the like. In some embodiments, the rocking motion of infant support 3 is similar to swings having four-bar linkages with compound axes.

Figure 5B:
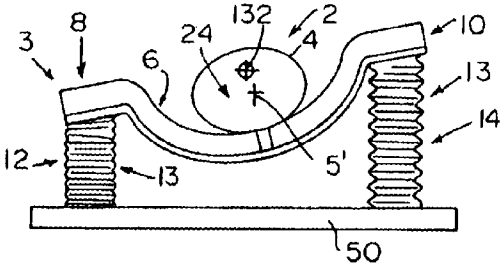
FIGS. 5*a* through 5*c* are end views of the infant rocking apparatus of FIG. 1 showing the infant support in the home position and in the first and second tilted positions, respectively.
Figure 5A:
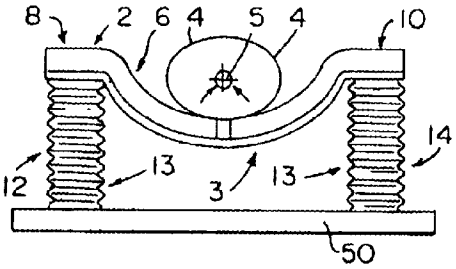
Figure 5C:
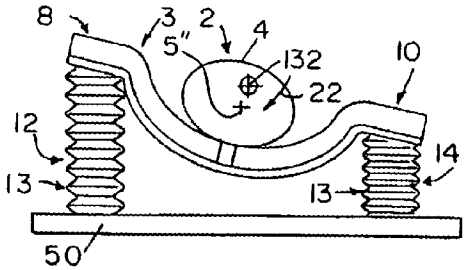

In the FIGS. 3*a* and 5*a*–5*c* example, as infant support 3 tilts from the home position to the first tilted position, a longitudinal center line of the infant 4 moves from position 5, shown in FIGS. 3*a*, 3*b* and 5*a*, to position 5', shown in FIGS. 3*a*, 3*b* and 5*b*, and as infant support 3 tilts from the home position to the second tilted position, the longitudinal centerline of the infant 4 moves from position 5 to position 5", shown in FIGS. 3*a*, 3*b* and 5*c*. As infant support 3 tilts, the center of trough 6 (i.e. the portion of trough 6 vertically beneath centerline 5 when infant support 3 is in the home position) shifts laterally since it is positioned below the "effective" pivot axis about which infant support 3 tilts or pivots. In addition, so long as the centerline 5 of infant 4 is offset from the "effective" pivot axis of infant support 3, the centerline 5 of infant 4 will experience movement in both the vertical and horizontal directions as infant support 3 tilts or pivots. For example, when infant support 3 is moved between the first and second tilted positions as shown in FIG. 3*a*, the centerline 5 of infant 4 moves vertically by a distance 58 and horizontally by a distance 59 as shown diagrammatically in FIG. 3*b*.

The depth of trough 6 affects the amount of vertical and horizontal movement of infant 4 as infant support 3 is rocked. Thus, assuming that infant support 3 is rocked through substantially identical angular displacements with identical bellows inflation control, the vertical and horizontal movements of the centerline 5 of infant 4 are greater than distances 58, 59, respectively, in those embodiments of infant support 3 having a trough deeper than illustrative trough 6.

It will be appreciated that, as infant support 3 tilts, bellows 12, 14 become distorted due to mechanical forces imparted on the upper ends of bellows 14 by infant support 3 and that the horizontal distance between the upper ends of bellows 12, 14 shortens as infant support 3 is tilted away from the home position. It will also be appreciated that bellows 12, 14 become more rigid as they are inflated. Thus, the side portion 8, 10 of infant support 3 being raised from the home position will have a tendency to move substantially vertically upwardly, whereas the side portion 8, 10 being lowered from the home position will have a tendency to move inwardly toward the space between bellows 12, 14. As a result, infant support 3 experiences lateral shifting while being tilted between the first and second tilted positions. It will be appreciated therefore, that during pivoting movement of infant support 3 in directions 22, 24, the "effective" pivot axis may not remain fixed in space.

Figure 4:
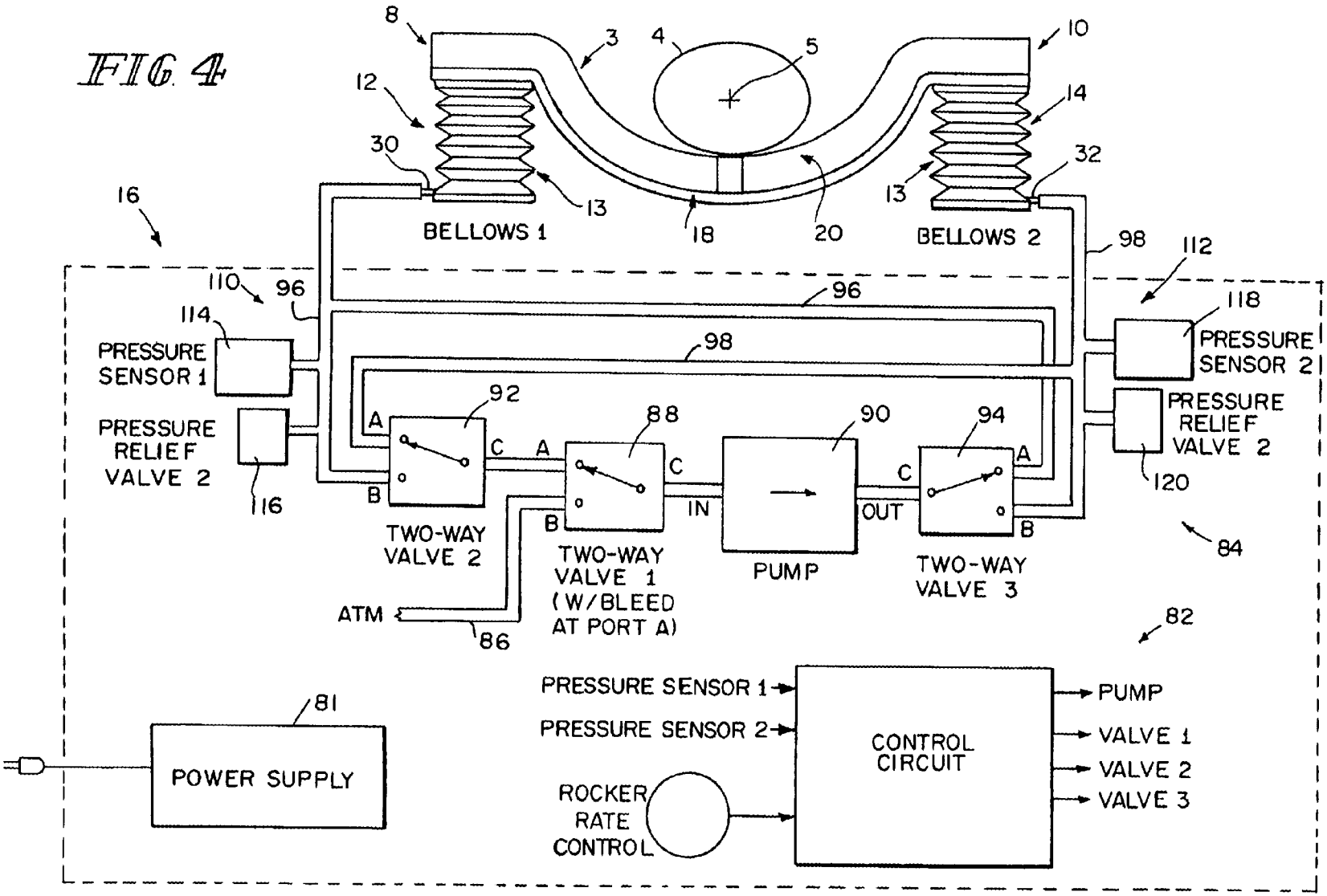
FIG. 4 is an end view of the apparatus of FIG. 1 and a diagrammatic view of the control system of the apparatus.

The illustrative control system 16 comprises three primary components: a power supply 81, a control circuit 82, and a pump assembly 84 as shown diagrammatically in FIG. 4. Supply 81 provides power to system 16. Control circuit 82 controls assembly 84 to control the amount and rate of air or other fluid that enters or exits either bellows 12, 14 for creating the rocking movement. Control circuit 82 regulates the movement of bellows 12, 14 at selected amplitudes and frequencies.

Air is supplied to pump assembly 84 through tube 86 when valve 88 is switched to its port B for communication with tube 86. Once pump assembly 84 receives a sufficient supply of air, valve 88 is switched to its port A position.

At the direction of circuit 82, pump assembly 84 transfers air back and forth between bellows 12, 14 in an oscillatory manner. Depending upon the configuration of valves 88, 92, and 94, air is transferred from bellows 14 to bellows 12 to thereby deflate bellows 14 and inflate bellows 12 or air is transferred from bellows 12 to bellows 14 to deflate bellows 12 and inflate bellows 14. Each of valves 88, 92, and 94 is switched to its port A position to transfer air from bellows 14 to bellows 12. In this configuration, air flows from bellows 14 through tube 98, valve 92, valve 88, pump 90, valve 94, and tube 96 to bellows 12. To transfer air from bellows 12 to bellows 14, valves 92 and 94 are switched to their port B positions and valve 88 remains at its port A position. In this configuration, air flows from bellows 12 through tube 96, valve 92, valve 88, pump 90, valve 94, and tube 98 to bellows 14.

A pressure relief system 110, 112 is coupled to each of tubes 96, 98, respectively, as shown diagrammatically in FIG. 4. System 110 comprises a pressure sensor 114 coupled to a portion of line 96 for determining the pressure in line 96, and a pressure relief valve 116 for bleeding air, if necessary to prevent the overinflation of bellows 12. Similarly, system 112 comprises a pressure sensor 118 coupled to a portion of line 98 for determining the pressure in line 98, and a pressure relief valve 120 for bleeding air, if necessary to prevent the overinflation of bellows 14. In the illustrative embodiments, control system 16 operates so as to provide a smooth and even rocking motion of infant support 3 by ensuring substantially equivalent volumes of air is entering one of bellows 12, 14 and exiting the other of bellows 12, 14.

In some instances, valve 88 is moved to a position in communication with tube 86 so that air is supplied directly to one or both of bellows 12, 14 from atmosphere through tube 86. Thus, it is possible for control system 16 to inflate one of bellows 12, 14 while the other of bellows 12, 14 remains static. To supply air to bellows 12 in this "direct-fill" manner, for example, valve 88 is switched to its port B position and valve 94 is switched to its port A position so that air flows from atmosphere through tube 86, valve 88, pump 90, valve 94, tube 96 to bellows 12. In contrast, to supply air to bellows 14 in this "direct-fill" manner, valves 88 and 94 are switched to their port B positions so that air flows from atmosphere through tube 86, valve 88, pump 90, valve 94, tube 98 to bellows 14. Valve 88 is switched back to its port A position after directly filling either bellows 12, 14. Valve 88 is movable to a position to bleed air from its port A to provide pump assembly 84 with a controlled leak for reducing the amount of air in pump assembly 84 and bellows 12, 14. Alternatively, rather than receiving air from atmosphere, control system 16 receives air from a positive pressure air or medical gas source of a hospital or infant care facility for distribution to bellows 12, 14.

In the illustrative embodiments of FIGS. 1–5*c*, bellows 12, 14 extend generally vertically beneath respective side portions 8, 10 of infant support 3. However, it is within the scope of this disclosure for bellows 12, 14 to have orientations other than vertical. For example, in the embodiment of FIGS. 6*a*–6*c*, bellows 12, 14 extend downwardly and outwardly from respective side portions 8, 10 of infant support 3. In contrast, in the embodiment of FIGS. 7*a*–7*c*, bellows 12, 14 extend downwardly and inwardly from respective side portions 8, 10 of infant support 3. By changing the orientation of bellows 12, 14 relative to infant support 3, the movement of infant support 3 and the associated movement of the longitudinal centerline 5 of infant 4 relative to its original position 132 (i.e. the position of longitudinal centerline 5 when infant support 3 is in the home position) is changed.

Figure 6B:
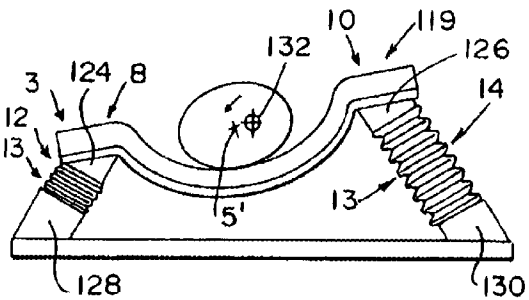
FIGS. 6*a* through 6*c* are end views similar to FIGS. 5*a* through 5*c* of another embodiment of an infant rocking apparatus having pneumatic bellows that extend downwardly and outwardly from an infant support of the apparatus.
Figure 6A:
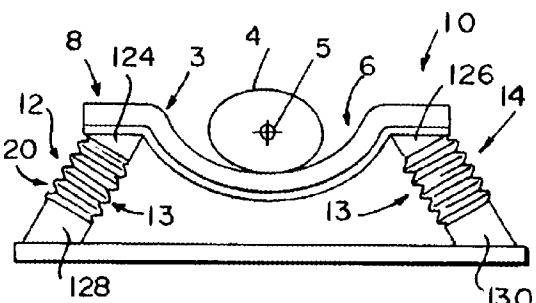
Figure 6C:
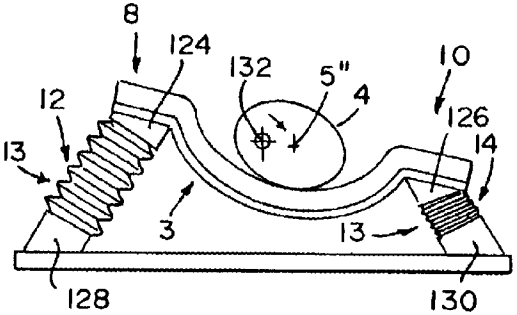

In the embodiment illustrated in FIGS. 6*a*–6*c*, side portions 8, 10 are attached to angled first blocks 124, 126, respectively. Bellows 12, 14 are attached to first blocks 124, 126, respectively, and to angled second blocks 128, 130, respectively. When bellows 12 is lowered and bellows 14 is raised, as shown in FIG. 6*b*, centerline 5 moves downward and to the left relative to its original position, identified by reference numeral 132. Conversely, when bellows 12 is raised and bellows 14 is lowered, as shown in FIG. 6*c*, centerline 5 moves downward and to the right relative to its original position 132. This motion of centerline 5 is different from the motion of centerline 5 shown in FIGS. 5*a*–5*c*. When bellows 12 is lowered and bellows 14 is raised in FIG. 5*b*, centerline 5 moves downward and to the right relative to original position 132. When bellows 12 is raised and bellows 14 is lowered in FIG. 5*c*, centerline 5 moves downward and to the left relative to original position 132.

Figure 7B:
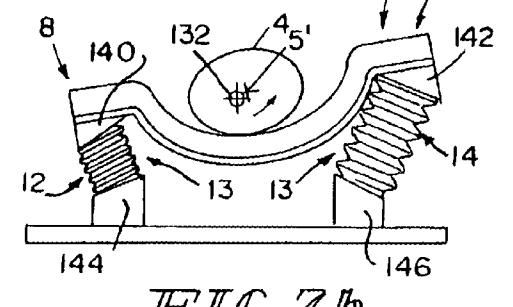
FIGS. 7*a* through 7*c* are end views similar to FIGS. 6*a* through 6*c* of another embodiment of an infant rocking apparatus having pneumatic bellows that extend downwardly and inwardly from an infant support of the apparatus.
Figure 7A:
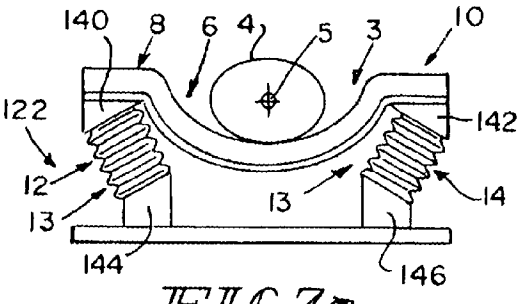
Figure 7C:
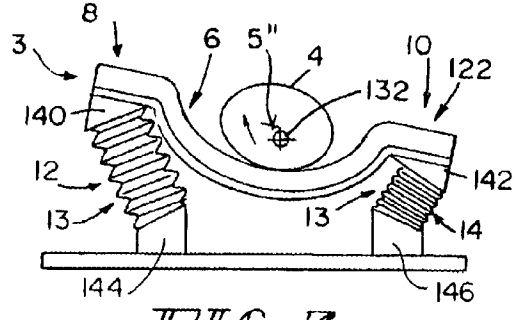

In the embodiment shown in FIGS. 7*a*–7*c*, side portions 8, 10 are attached to angled first blocks 140, 142, respectively. Bellows 12, 14 are attached to first blocks 140, 142, respectively, and second blocks 144, 146, respectively. When bellows 12 is lowered and bellows 14 is raised, as shown in FIG. 7*b*, centerline 5 moves upwardly and to the right relative to the original position 132. Conversely, when bellows 12 is raised and bellows 14 is lowered, as shown in FIG. 7*c*, centerline 5 moves upwardly and to the left relative to the original position 132.

Although lifters 13 of the illustrative embodiments of FIGS. 1–7*c* are pneumatic bellows 12, 14, it is within the scope of this disclosure for other types of lifters 13 to be used to rock infant support 3. For example, in the embodiment shown in FIGS. 8*a* trough 10*c*, lifters 13 comprise pneumatic cylinders 60, 62. In the embodiment shown in FIGS. 11 through 12*c*, lifters 13 comprise links 100, 102 that are moved by an actuator 220. In each of the illustrative embodiments, lifters 13 are coupled to side portions 8, 10 of infant support 3. However, it is within the scope of this disclosure for lifters 13 to be coupled to any portion of infant support 3, including trough 6. Thus, unless specifically stated otherwise, the term "side portions," as used in the claims, is meant to include portions of infant support 3 extending away from trough 6, such as portions 8, 10; portions of trough 6 that are off-center; and portions of infant supports having other shapes, including flat infant supports, that are off-center.

An illustrative rocking apparatus 300 includes two cylinders 60, 62 in place of bellows 12, 14. It is within the scope of this disclosure for rocking apparatus 300 to have two or more cylinders connected to respective side portions 8, 10. In some embodiments, each cylinder 60, 62 is a pneumatic cylinder and is attached to corresponding side portion 12, 14. Each cylinder 60, 62 comprises a housing 64, 65, respectively, and a rod 68, 69, respectively (FIGS. 8*a*–8*c*) that extends from or retracts into the associated housing 64, 65 in a conventional manner. A lower end of each housing 64, 65 is pivotally attached to brackets 66, 67, respectively, and an upper end of each rod 68, 69 is attached to a respective side portion 8, 10. Illustrative brackets 66, 67 are attached to base 150. In alternative embodiments, the lower end of cylinders 64, 65 are pivotably coupled to a portion of an infant support device, such as a crib, an infant incubator, an infant warmer, or a bassinet.

It is contemplated that a control system similar to control system 16, shown in FIG. 4, is used to extend and retract pneumatic cylinders 60, 62 to control the movement of infant support 3 in the embodiments of FIGS. 8*a*–10*c*. Thus, the movement of cylinders 60, 62 is similar to the movement of bellows 12, 14 in that they are movable to pivot infant support 3 in directions 22, 24. In alternative embodiments, apparatus 300 has motorized lift screws or hydraulic cylinders in place of pneumatic cylinders 60, 62.

Figure 8B:
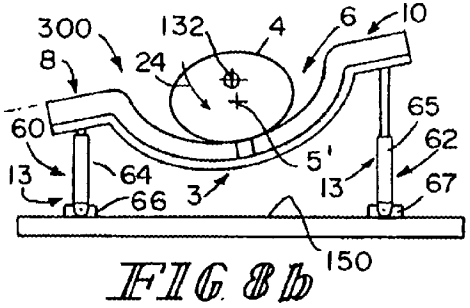
FIGS. 8*a* through 8*c* are end views similar to FIGS. 7*a* through 7*c* of another embodiment of an infant rocking apparatus showing an infant support of the apparatus being moved between a level or home position and first and second tilted positions, respectively, by a set of vertically extending pneumatic cylinders.
Figure 8A:
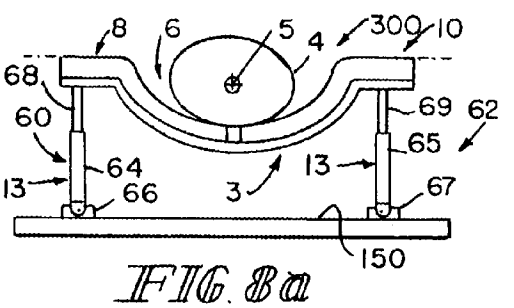

In the illustrative embodiment of FIGS. 8*a*–8*b*, cylinders 60, 62 extend generally vertically beneath respective side portions 8, 10 of infant support 3. However, it is within the scope of this disclosure for cylinders 60, 62 to have orientations other than vertical. For example, in the embodiment of FIGS. 9*a*–9*c*, cylinders 60, 62 extend downwardly and outwardly from respective side portions 8, 10 of infant support 3. In contrast, in the embodiment of FIGS. 10*a*–10*c*, cylinders 60, 62 extend downwardly and inwardly from respective side portions 8, 10 of infant support 3.

Figure 8C:
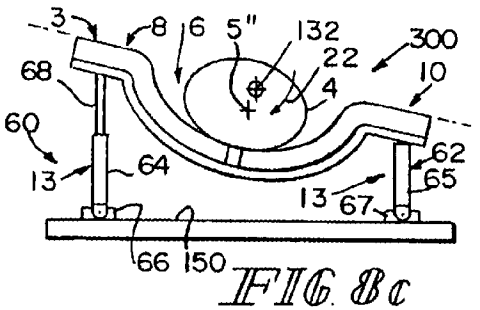
Figure 9B:
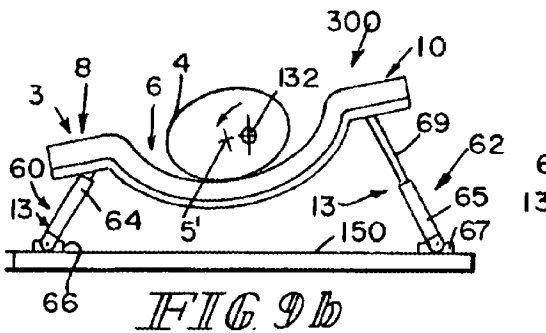
FIGS. 9*a* through 9*c* are end views similar to FIGS. 8*a* through 8*c* of another embodiment of an infant rocking apparatus having pneumatic cylinders that extend downwardly and outwardly from an infant support of the apparatus.
Figure 9A:
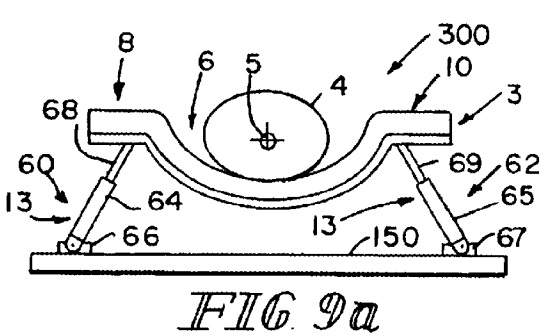
Figure 9C:
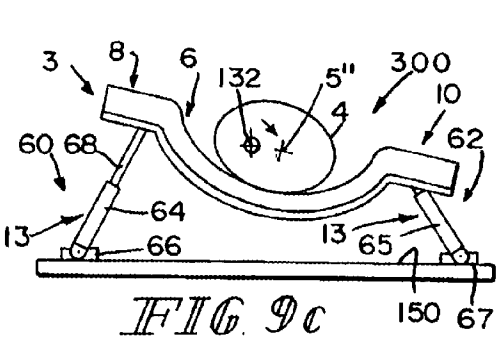

By changing the orientation of cylinders 60, 62 relative to infant support 3, the movement of infant support 3 and the associated movement of the longitudinal centerline 5 of infant 4 relative to its original position 132 (i.e. the position of longitudinal centerline 5 when infant support 3 is in the home position) is changed. For example, when cylinder 60 is lowered and cylinder 62 is raised in the embodiment of FIGS. 8*a*–8*c*, centerline 5 moves downwardly and to the right relative to original position 132 as shown in FIG. 8*b*. In contrast, when cylinder 60 is lowered and cylinder 62 is raised in the embodiment of FIGS. 9*a*–9*c*, centerline 5 moves downwardly and to the left relative to the original position 132 as shown in FIG. 9*b*. Furthermore, when cylinder 60 is raised and cylinder 62 is lowered in the embodiment of FIGS. 8*a*–8*c*, centerline 5 moves downwardly and to the left relative to original position 132 as shown in FIG. 8*c*. However, when cylinder 60 is raised and cylinder 62 is lowered in the embodiment of FIGS. 9*a*–9*c*, centerline 5 moves downwardly and to the right relative to the original position 132 as shown in FIG. 9*c*. Thus, the movement of centerline 5 in the embodiment of FIGS. 8*a*–8*c* is different than the movement of centerline 5 in the embodiment of FIGS. 9*a*–9*c*.

Figure 10B:
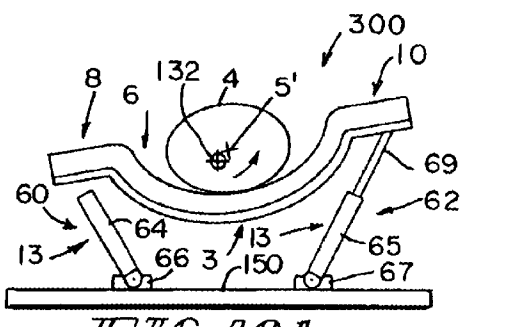
FIGS. 10*a* through 10*c* are end views similar to FIGS. 9*a* through 9*c* of another embodiment of an infant rocking apparatus having pneumatic cylinders that extend downwardly and inwardly from an infant support of the apparatus.
Figure 10A:
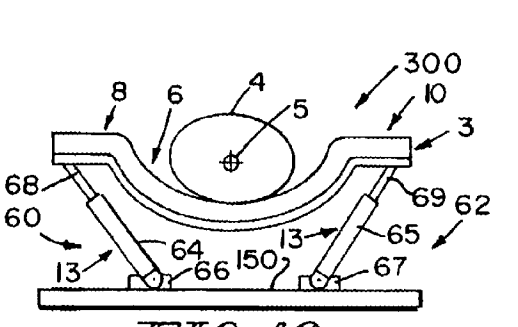
Figure 10C:
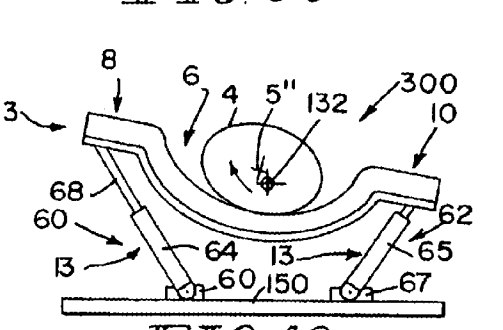

In the embodiment shown in FIGS. 10*a*–10*c*, cylinders 60, 62 extend downwardly and inwardly from side portions 8, 10 of infant support 3. Thus, brackets 66, 67 are closer to one another in the embodiment of FIGS. 10*a*–10*c* than in the embodiment of FIGS. 8*a*–8*b*. When cylinder 60 is lowered and cylinder 62 is raised, centerline 5 moves upwardly and to the right relative to the original position 132 as shown in FIG. 10*b*. Conversely, when cylinder 60 is raised and cylinder 62 is lowered, centerline 5 moves upward and to the left relative to the original position 132 as shown in FIG. 10*c*.

An alternative embodiment of a rocking apparatus 51 is shown in FIGS. 11 and 12*a*–12*c*. Lifters 13 of apparatus 51 comprise links 100, 102 that are attached to side portions 8, 10, respectively, and to a base 250. A pair of brackets 208 are coupled to side portion 8 of infant support 3 and a pair of brackets 209 are coupled to side portion 10 of infant support 3. In addition, a pair of brackets 210 are coupled to base 250 beneath side portion 8 and a pair of brackets 212 are coupled to base 250 beneath side portion 10. An upper end of each link 100 is pivotably coupled to a respective bracket 208 by an associated pivot pin 200 and a lower end of each link 100 is coupled to a respective bracket 210 by an associated pivot pin 202. Similarly, an upper end of each link 102 is coupled to bracket 209 by a pivot pin 204 and a lower end of each link 102 is coupled to bracket 212 by a pivot pin 206.

Figure 12C:
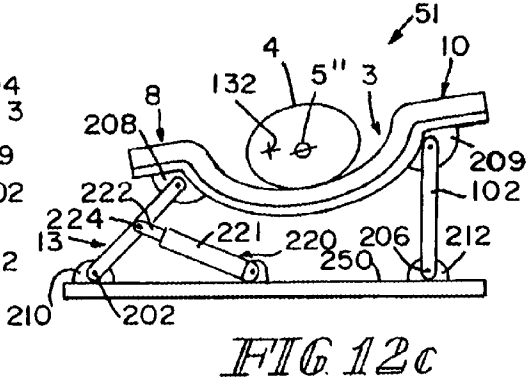
FIGS. 12*a* through 12*c* are end views of the infant rocking apparatus of FIG. 11 showing the infant support in a level or home position and in first and second tilted positions, respectively.
Figure 12A:
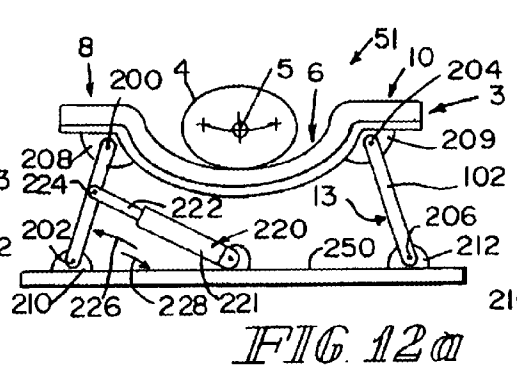
Figure 12B:
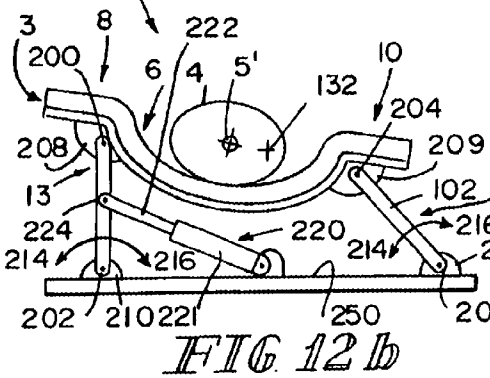

Apparatus 51 includes an actuator 220 that pivots links 100, 102 back and forth to rock infant support 3 between a home position, shown in FIG. 12*a*, a first tilted position, shown in FIG. 12*b*, and a second tilted position, shown in FIG. 12*c*. The rotational movement of links 100, 102 around pivot pins 202, 206 is indicated by double-headed direction arrow 214, 216. As links 100, 102 pivot in direction 214, portion 8 of infant support 3 is lifted upwardly and portion 10 of infant support 3 is lowered downwardly. In addition, as links 100, 102 pivot in direction 214, infant support 3 shifts laterally to the left as shown in FIGS. 12*a* and 12*b*. As links 100, 102 pivot in direction 216, portion 10 of infant support 3 is lifted upwardly and portion 8 of infant support 3 is lowered downwardly. In addition, as links 100, 102 pivot in direction 216, infant support 3 shifts laterally to the right as shown in FIGS. 12*a* and 12*c*.

Figure 11:
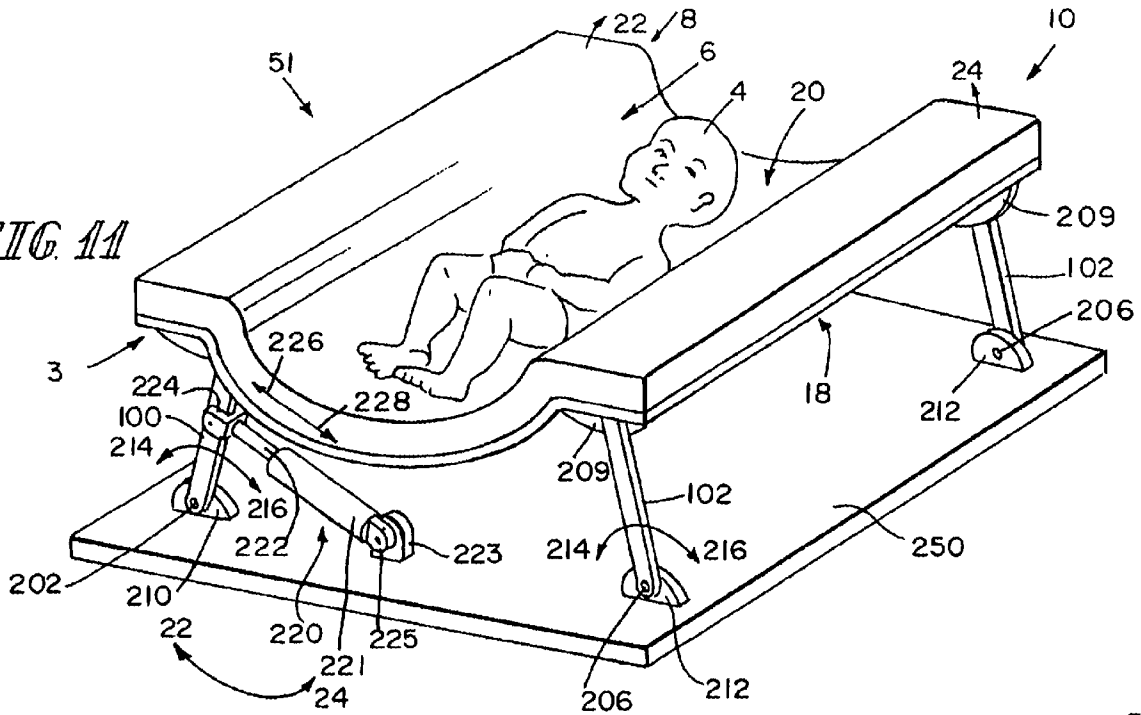
FIG. 11 is a perspective view of another embodiment of an infant rocking apparatus showing a base, an infant support above the base, a set of links interconnecting the infant support and the base, and an actuator interconnecting one of the links and the base.

Illustrative actuator 220 is a linear, pneumatic cylinder having a housing 221 and a rod 222 extending from housing 221, as shown best in FIG. 11. It will be appreciated that only a single cylinder is necessary to rock infant support 3 in directions 22, 24. Thus, coordination of adding air into one pneumatic actuator and simultaneously withdrawing air out of another pneumatic actuator is avoided in the illustrative apparatus 51. Although, illustrative cylinder 220 is a pneumatic cylinder. it is within the scope of this disclosure for apparatus 51 to have a hydraulic cylinder in lieu of the pneumatic cylinder. Other types of actuators, such as linear jack screws or rotary electric motors that act on links 100, 102 either directly on or through one or more transmission elements to pivot links 100, 102 in directions 214, 216 are within the scope of this disclosure.

An end 224 of rod 222 is pivotably coupled to a central portion of link 100 between pivot pins 200, 202. An end 225 of cylinder 220 is pivotably coupled to a bracket 223 which is, in turn, attached to base 250. Extending rod 222 in direction 226, shown in FIG. 12*a*, and retracting rod 222 in direction 228, also shown in FIG. 12*a*, causes links 100, 102 to pivot in directions 214, 216, respectively. This motion of link 100, in turn, causes infant support 3 to rock in directions 22, 24 as previously described. When rod 222 extends in direction 226, link 100 pivots in direction 214 to raise side portion 8 and lower side portion 10 as shown in FIG. 12*b*. When rod 222 retracts in direction 228, link 100 pivots in direction 216 to lower side portion 8 and raise side portion 10 as shown in FIG. 12*c*.

Figure 13:
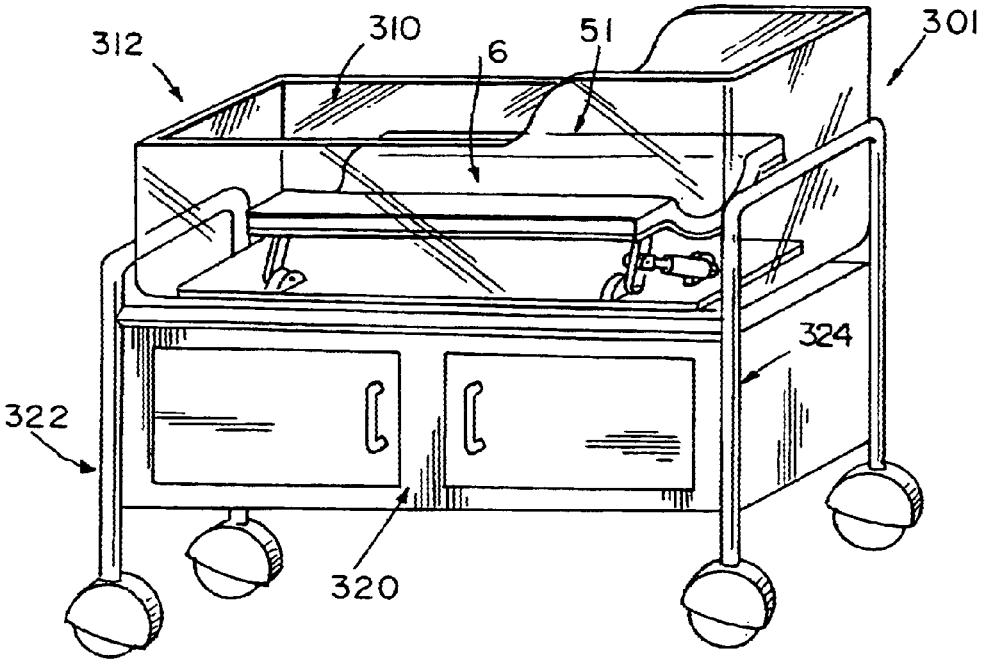
FIG. 13 is a perspective view of a nursery cart carrying a bassinet that includes the infant rocking apparatus of FIG. 11.
Figure 15:
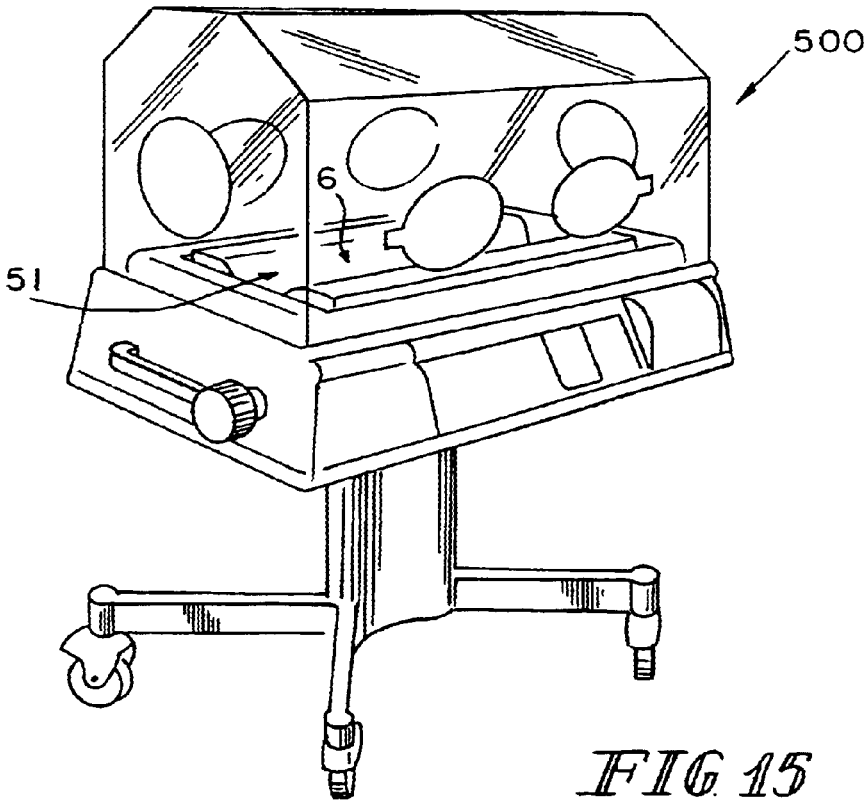
FIG. 15 is a perspective view of an infant incubator that includes the infant rocking apparatus of FIG. 11.
Figure 14:
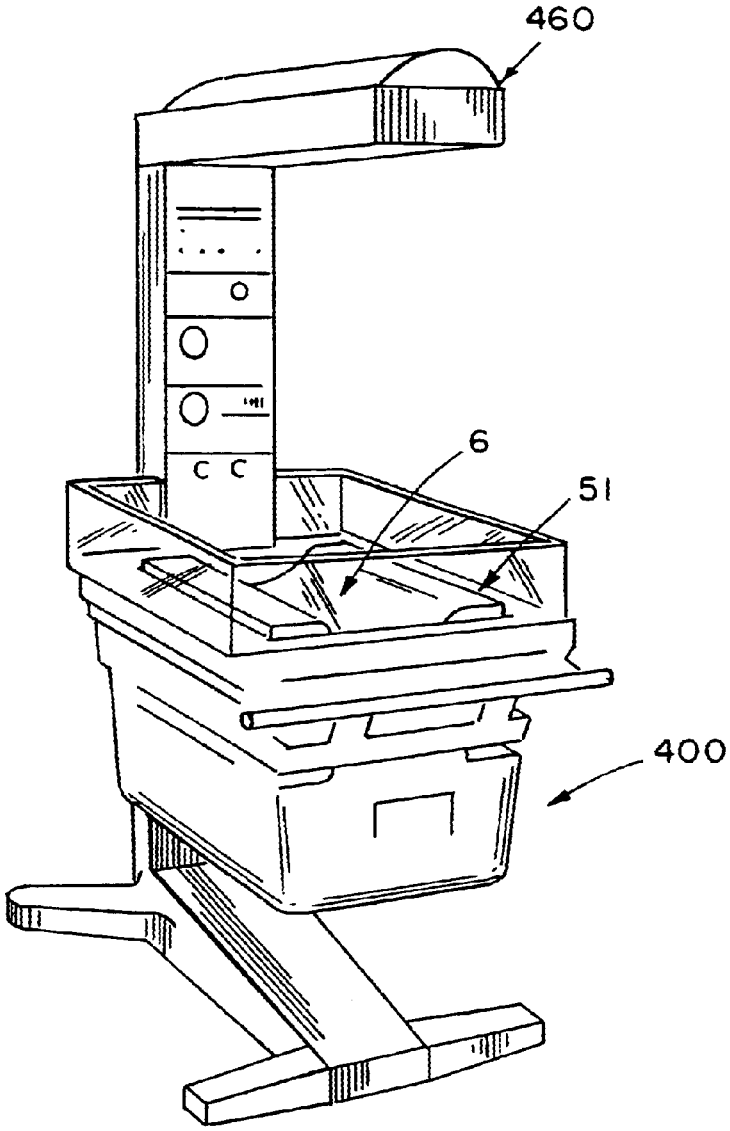
FIG. 14 is a perspective view of an infant warmer that includes the infant rocking apparatus of FIG. 11.

Apparatus 51 is illustrated as being used with a nursery cart 301, a warmer 400, and an incubator 500 in FIGS. 13–15, respectively. It is within the scope of this disclosure for any of the embodiments of infant rocking apparatus 2, 300, 51 to be placed in or integrated into any of cart 301, warmer 400, and incubator 500. Thus, the description below of employing apparatus 51 with cart 301, warmer 400, and incubator 500 applies also to the other embodiments as well. In addition, apparatus 2, 300, 51 may be placed in or integrated into other infant support devices, such as cribs and bassinets.

As shown in FIG. 13, apparatus 51 is received within cavity 310 of a bassinet 312 which provides the upper portion of nursery cart 301. Nursery cart 301 and bassinet 312 typically serves as a cradle for infants after they are born, and before they leave the hospital. Cart 301 includes a base structure 320 having a pair of frames members 322, 324. Rollers 326 depend from the lowermost portions of frame members 322, 324 for transporting cart 300 between a nursery and the parents' hospital room, for example.

Infant warmer 400 provides an open surface upon which a care giver can examine the infant, particularly just shortly after delivery, while providing warmth to the infant with overhead warmer 410. In the illustrated embodiment, rocking apparatus 51 is shown partially recessed within a cavity in warmer 400. This allows apparatus 51 to move in directions 22, 24 while concealing links 100, 102, cylinder 220, and associated structures to avoid interference with a care giver providing care to infant 4 positioned on trough 6. Similarly, infant incubator 500 has a recess to receive apparatus 51 for the aforementioned reasons.

Although certain illustrative embodiments have been described in detail above, variations and modifications exist within the scope and spirit of this disclosure as described and as defined in the following claims.

What is claimed is:

1. An infant support device comprising a base, and an infant rocking apparatus comprising an infant support having opposite ends and longitudinally-extending side portions, the infant support having a trough comprising sides and central portion and extending longitudinally centrally between the side portions, the trough being configured to receive an infant between the sides, the infant rocking apparatus having a pair of power-operated lifters that move to rock the infant support side to side, the lifters having upper ends coupled to respective side portions of the infant support above the base, and the lifters having lower ends coupled to the base below the respective side portions.

2. The infant support device of claim 1, wherein a space is defined between the lifters and at least a portion of the trough is received in the space.

3. The infant support device of claim 1, wherein the trough has a central portion positioned lower than the side portions.

4. The infant support device of claim 1, further comprising a control coupled to the lifters and configured to rock the infant support at selected amplitudes and frequencies.

5. The infant support device of claim 1, wherein each lifter comprises a motor-driven lifter.

6. The infant support device of claim 1, wherein each lifter extends downwardly and inwardly relative from the infant support.

7. The infant support device of claim 1, wherein each lifter has a plurality of links movably attached to the infant support.

8. The infant support device of claim 7, further comprising an actuator coupled to at least one of the links and the actuator being movable to pivot the links to raise and lower each side portion to rock the infant support.

9. An infant support device comprising a base, and an infant rocking apparatus comprising an infant support having opposite ends and longitudinally-extending side portions, the infant support having a trough extending longitudinally centrally between the side portions, the trough being configured to receive an infant extending longitudinally therein, the infant rocking apparatus having a pair of lifters that move to rock the infant support side to side, the lifters having upper ends coupled to respective side portions of the infant support, and the lifters having lower ends coupled to the base, each lifter having a fluid cylinder.

10. The infant support device of claim 9, further comprising a control system configured to direct fluid into and between each cylinder to rock the infant support cyclically.

11. An infant support device comprising a base, and an infant rocking apparatus comprising an infant support having opposite ends and longitudinally-extending side portions, the infant support having a trough extending longitudinally centrally between the side portions, the trough being configured to receive an infant extending longitudinally therein, the infant rocking apparatus having a pair of lifters that move to rock the infant support side to side, the lifters having upper ends coupled to respective side portions of the infant support, and the lifters having lower ends coupled to the base, each lifter comprising a pneumatic bellows.

12. The infant support device of claim 11, wherein each of the pneumatic bellows has an interior region and at least one member situated in the interior region for supporting the infant support.

13. The infant support device of claim 12, wherein the at least one member comprises at least one spring.

14. An infant support device comprising a base, and an infant rocking apparatus comprising an infant support having opposite ends and longitudinally-extending side portions, the infant support having a trough extending longitudinally centrally between the side portions, the trough being configured to receive an infant extending longitudinally therein, the infant rocking apparatus having a pair of lifters that move to rock the infant support side to side, the lifters having upper ends coupled to respective side portions of the infant support, and the lifters having lower ends coupled to the base, each lifter extending downwardly and outwardly from the infant support.

15. An infant rocking apparatus comprising an infant support having opposite ends, longitudinally-extending side portions, and a trough for conformingly receiving an infant, the trough comprising sides and a central portion extending longitudinally centrally between the side portions and with the central portion being lower than the side portions, a pair of power-operated lifters coupled to the side portions and operable to raise and lower the side portions to rock the infant support from side to side, each lifter having a fluid cylinder, and a control system that operates the lifters to rock the infant support.

16. The rocking apparatus of claim 15, wherein a space is defined between the pair of lifters and at least a portion of the trough is positioned in the space.

17. The rocking apparatus of claim 16, wherein the lifters comprise motor-driven lifters.

18. The rocking apparatus of claim 16, further comprising a base situated below the infant support and each of the lifters being coupled to the base.

19. The rocking apparatus of claim 16, wherein each of the lifters extends downwardly and inwardly from the infant support.

20. The rocking apparatus of claim 16, wherein the lifters comprise a plurality of links movably attached to the infant support.

21. The rocking apparatus of claim 20, further comprising an actuator coupled to one of the links to move the links for rocking the infant support.

22. The rocking apparatus of claim 15, wherein the side portions each have an upper surface that is planar and the trough has an upper surface that is concave.

23. The rocking apparatus of claim 22, wherein the side portions each have a bottom surface that is planar and the trough has a bottom surface that is convex.

24. An infant rocking apparatus comprising an infant support having opposite ends, longitudinally-extending side portions, and a trough for conformingly receiving an infant, the trough extending longitudinally centrally between the side portions and including a central portion being lower than the side portions, a pair of lifters coupled to the side portions and operable to raise and lower the side portions to rock the infant support from side to side, a space being defined between the pair of lifters and at least a portion of the trout being positioned in the space, the lifters comprising pneumatic lifters, and a control system that operates the lifters to rock the infant support.

25. An infant rocking apparatus comprising an infant support having opposite ends, longitudinally-extending side portions, and a trough for conformingly receiving an infant, the trough extending longitudinally centrally between the side portions and including a central portion being lower than the side portions, a pair of lifters coupled to the side portions and operable to raise and lower the side portions to rock the infant support from side to side, a space being defined between the pair of lifters and at least a portion of the trough being positioned in the space, the lifters comprising pneumatic cylinders, and a control system that operates the lifters to rock the infant support.

26. An infant rocking apparatus comprising an infant support having opposite ends, longitudinally-extending side portions, and a trough for conformingly receiving an infant, the trough extending longitudinally centrally between the side portions and including a central portion being lower than the side portions, a pair of lifters coupled to the side portions and operable to raise and lower the side portions to rock the infant support from side to side, a space being defined between the pair of lifters and at least a portion of the trough being positioned in the space, the lifters comprising pneumatic bellows, and a control system that operates the lifters to rock the infant support.

27. The rocking apparatus of claim 26, wherein the bellows have structural members for supporting the infant support.

28. The rocking apparatus of claim 27, wherein the structural members comprise springs.

29. An infant rocking apparatus comprising an infant support having opposite ends, longitudinally-extending side portions, and a trough for conformingly receiving an infant, the trough extending longitudinally centrally between the side portions and including a central portion being lower than the side portions, a pair of lifters coupled to the side portions and operable to raise and lower the side portions to rock the infant support from side to side, a space being defined between the pair of lifters and at least a portion of the trough being positioned in the space, each of the lifters extending downwardly and outwardly from the infant support, and a control system that operates the lifters to rock the infant support.

30. An infant rocking apparatus comprising an infant support having an upwardly-facing upper surface and a downwardly-facing bottom surface, a longitudinally-extending central region of the upper surface for supporting an infant thereon and being lower in elevation than a pair of longitudinally-extending downwardly facing side portions of the bottom surface, and a power-operated lifter having an upper portion that is coupled to one of the longitudinally-extending side portions of the bottom surface and extends downwardly therefrom, and the lifter being operable to rock the infant support.

31. The infant-support apparatus of claim 30, further comprising a control for the lifter, the control being configured to rock the infant support at selected amplitudes and frequencies.

32. The infant-support apparatus of claim 30, further comprising a base and the lifter having a bottom portion that is coupled to the base.

33. The infant-support apparatus of claim 32, wherein the infant support remains spaced apart from the base while being rocked by the lifter.

34. The infant-support apparatus of claim 30, further comprising a second lifter having an upper portion coupled to the other of the side portions of the bottom surface.

35. The infant-support apparatus of claim 34, wherein each of the lifters extends downwardly and inwardly from the infant support.

36. The infant-support apparatus of claim 34, wherein each of the lifters extends downwardly and outwardly from the infant support.

37. The infant-support apparatus of claim 34, wherein each of the lifters extends vertically downwardly from the infant support when the infant support is in a level position.

38. The infant-support apparatus of claim 30, wherein the lifter comprises a plurality of links movably attached to the infant support.

39. The infant-support apparatus of claim 38, further comprising an actuator coupled to at least one of the links and the actuator being movable to rock the infant support.

40. The infant-support apparatus of claim 30, wherein the lifter extends and contracts to rock the infant support.

41. The infant-support apparatus of claim 30, wherein the lifter comprises a lift cylinder.

42. The infant-support apparatus of claim 41, wherein the lift cylinder comprises a pneumatic cylinder.

43. The infant-support apparatus of claim 30, wherein the lifter comprises a pneumatic bellows.

44. The infant-support apparatus of claim 30, wherein the lifter comprises a motor-driven lifter.

45. An infant rocking apparatus comprising an infant-support for receiving an infant, the infant support having longitudinally-extending side portions and a trough comprising sides and a central portion extending longitudinally centrally between the side portions, a mattress supported on the infant support, the mattress having portions extending over the longitudinally-extending side portions, and power-operated means for rocking the infant support about a changeable longitudinal axis between first and second tilted positions.

46. The rocking apparatus of claim 45, wherein the side portions are planar.

47. The rocking apparatus of claim 45, wherein the means for rocking the infant support comprises a pair of lifters arranged to define a space therebetween and at least a portion of the trough is situated in the space.

48. An infant rocking apparatus comprising an infant support having opposite ends and longitudinally-extending side portions, an infant-support surface extending longitudinally centrally between the side portions, at least one link having an upper end coupled to each of the side portions and extending downwardly therefrom, and an actuator coupled to one of the at least one links, the actuator being operable to rock the infant support around an axis spaced above the support surface, the actuator and each of the at least one links being positioned below the infant support, the actuator including a fluid cylinder.

49. The rocking apparatus of claim 48, further comprising a base, the links being pivotably coupled to the base, and the actuator being pivotably coupled to the base.

50. The rocking apparatus of claim 49, wherein the infant support remains spaced apart from the base while being rocked.

51. The rocking apparatus of claim 49, wherein the base comprises a planar member.

52. An infant rocking apparatus comprising an infant support having opposite ends and longitudinally-extending side portions, an infant-support surface extending longitudinally centrally between the side portions, at least one link coupled to each of the side portions, and an actuator coupled to one of the at least one links, the actuator being operable to rock the infant support around an axis spaced above the support surface, the actuator and each of the at least one links being positioned below the infant support, and each link extending downwardly and outwardly from the infant support.

53. An infant rocking apparatus comprising an infant support having opposite ends and longitudinally-extending side portions, an infant-support surface extending longitudinally centrally between the side portions, at least one link coupled to each of the side portions, and an actuator coupled to one of the at least one links, the actuator being operable to rock the infant support around an axis spaced above the support surface, the actuator and each of the at least one links being positioned below the infant support, and the actuator comprising a pneumatic actuator.

54. An infant support device comprising a platform, an infant support having opposite ends, longitudinally-extending side portions, and a trough comprising sides and a central portion for conformingly receiving an infant, the trough extending longitudinally centrally between the side portions and with the central portion that is lower than the side portions, a pair of links, each link having an upper end pivotally coupled to one of the longitudinally-extending side portions and extending downwardly therefrom, and each link having a lower end pivotally coupled to the platform, and a power-operated actuator coupled to at least one of the links and coupled to the platform, the actuator being movable to rock the infant support side to side.

55. The infant support device of claim 54, further comprising a control system configured to move the actuator to rock the infant support at selected amplitudes and frequencies.

56. The infant support device of claim 54, wherein the platform is included as part of an infant warmer.

57. The infant support device of claim 54, wherein the platform is included as part of an infant incubator.

58. The infant support device of claim 54, wherein the platform is included as part of a nursery cart.

59. The infant support device of claim 54, wherein the platform is included as part of a crib.

60. An infant support device comprising a platform, an infant support having opposite ends, longitudinally-extending side portions, and a trough for conformingly receiving an infant, the trough extending longitudinally centrally between the side portions and including a central portion that is lower than the side portions, a pair of links, each link having first and second ends, each first end being pivotably coupled to the platform, and each second end being pivotably coupled to one of the side portions of the infant support, and an actuator coupled to at least one of the links and coupled to the platform, the actuator being movable to rock the infant support side to side, the actuator comprising a pneumatic actuator.

* * * * *